United States Patent [19]

Fecker et al.

[11] 4,047,398

[45] Sept. 13, 1977

[54] YARN GUIDE FINGER FOR POSITIVE YARN SUPPLY APPARATUS

[75] Inventors: Josef Fecker, Steinhofen-Bisingen; Gustav Memminger, Freudenstadt, both of Germany

[73] Assignee: Firma Gustav Memminger Verfahrenstechnik fur die Maschenindustrie, Freudenstadt, Germany

[21] Appl. No.: 642,257

[22] Filed: Dec. 19, 1975

[30] Foreign Application Priority Data

Dec. 31, 1974 Germany ..... 2461938

[51] Int. Cl.[2] ..... D04B 15/48; B65H 51/20; D04B 15/54

[52] U.S. Cl. ..... 66/132 R; 242/47.01; 66/161

[58] Field of Search ..... 66/132 R, 132 T, 161; 242/47.01, 47.12

[56] References Cited

U.S. PATENT DOCUMENTS

| | | | |
|---|---|---|---|
| 3,361,317 | 1/1968 | Levin | 66/132 T X |
| 3,523,433 | 8/1970 | Hatay | 66/132 R |
| 3,672,590 | 6/1972 | Rosen | 66/132 R X |
| 3,675,446 | 7/1972 | Cooke | 66/132 T |
| 3,785,176 | 1/1974 | Hebbecker et al. | 66/132 T |
| 3,883,083 | 5/1975 | Rosen | 66/132 R X |
| 3,904,141 | 9/1975 | Rosen | 66/132 R X |
| 3,908,921 | 9/1975 | Jacobsson | 66/132 R X |
| 3,928,987 | 12/1975 | Jacobsson | 66/132 R |
| 3,939,671 | 2/1976 | Lawson et al. | 66/132 R X |
| 3,994,446 | 11/1976 | Jacobsson | 66/132 R |

FOREIGN PATENT DOCUMENTS

| | | | |
|---|---|---|---|
| 1,192,108 | 5/1970 | United Kingdom | 242/47.01 |

*Primary Examiner*—Mervin Stein
*Assistant Examiner*—Andrew M. Falik
*Attorney, Agent, or Firm*—Flynn & Frishauf

[57] ABSTRACT

A rotatable storage drum is connected for rotation to have yarn wound thereon. The pull-off position of the yarn is controlled by a yarn guide element which is a pin extending into the path of the yarn and forming an acute angle with a plane parallel to the axis of rotation of the drum. The pin is located on a rotatable disk so that the point of the acute angle can face either forwardly or rearwardly of the drum, so that the thread guide element can guide the yarn regardless of the direction of rotation of the drum and without tangling of the yarn if the guide element is set incorrectly with respect to the direction of rotation thereof; the element can also be set in an intermediate position in which it is ineffective with respect to the pull-off position, so that the drum can be used as a demand-storage supply drum, rotatable in either direction without structural modification of the overall apparatus.

21 Claims, 7 Drawing Figures

YARN GUIDE FINGER FOR POSITIVE YARN SUPPLY APPARATUS

The copending U.S. filed applications disclosing related subject matter and filed by the same Applicants are Ser. Nos. 642,655 and 642,605, both filed on Dec. 19, 1975.

The present invention relates to positive yarn supply apparatus for textile machinery and more particularly to a yarn supply apparatus adapted to supply yarn or thread to circular knitting machines which is versatile and can operate in alternate directions of rotation without requiring structural modifications in the apparatus.

A positive yarn supply apparatus, as disclosed, for example, in German Disclosure Document DT-OS 2,312,933, uses a hook for a yarn guide element which is either in engagement with the yarn or which can be rotated out of the path of the yarn, as desired. In the effective position, that is, when the hook is in interfering position with respect to the path of the yarn, the pull-off point of the yarn from the storage drum is maintained fixed in space, so that the same amount of yarn is pulled off the storage drum as that which is wound on at the other side thereof. If the hook is rotated in ineffective position—which is possible in the structure referred to since it is retained on a rotatable rod—then the yarn can be freely pulled off over the head of the drum in downward direction, and more or less yarn can be removed from the drum than that which is being wound or has been wound thereon. Storage drums for thread supply devices ued in circular knitting machines are usually driven by a belt running circumferentially with respect to the machine. Some knitting machines operate in clockwise direction, others in counter-clockwise direction. It has in the past, therefore, been necessary to construct yarn supply apparatus separately for clockwise or counterclockwise operating circular knitting machines; or separately assembling the yarn guide apparatus to be specifically adapted to the one or the other direction of rotation.

It is an object of the present invention to provide a positive yarn supply apparatus in which a rotatable drum is used to provide positive yarn supply, and which is independent of the direction of rotation and additionaly is versatile so that it can be used also as a yarn storage drum.

SUBJECT MATTER OF THE PRESENT INVENTION

Briefly, the yarn guide element is so arranged that it can be selectively set for either direction of rotation of the storage drum by being adjustably secured to a support to extend, selectively, in the path of the thread as it is being wound from the drum, and regardless of direction of rotation of the drum.

The yarn supply apparatus can be used selectively with drums operating in clockwise as well as in counterclockwise direction of rotation, and thus can be used for example with circular textile machinery such as circular knitting machines, regardless of the direction of operation of the machine. It is only necessary to wind the yarn on the storage drum in the reverse direction of rotation and to change the yarn guide element by a simple setting operation to fit the direction of rotation of the drum. Double bearings and maintenance of special yarn guide apparatus specifically adapted for the one or the other direction of rotation thus is no longer necessary and the number of yarn supply apparatus which has to be kept in stock as well as their replacement or repair parts can be cut in half for any particular knitting machine installation.

If the yarn guide element happens to be set improperly with respect to the direction of rotation, then the yarn itself is automatically released from the yarn guide element. Thus, inadvertent incorrect setting of the yarn guide element does nt pinch or jam the thread, thus avoiding breakage; tangling of the thread is likewise avoided. If the yarn guide element does not, however, properly guide the yarn, thread tension is released and the stop-motion apparatus of the machine will respond. Thus, the apparatus is fail-safe, that is, the machine will stop upon incorrect setting without, however, damage to the yarn or thread, tearing thereof, or damage to the fabric.

The invention will be described by way of example with reference to the accompanying drawings, wherein.

Figure 4:
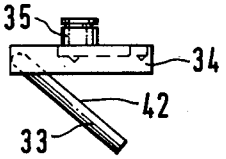
Figure 5:
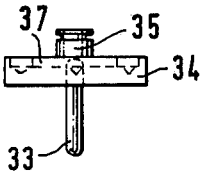
Figure 3:
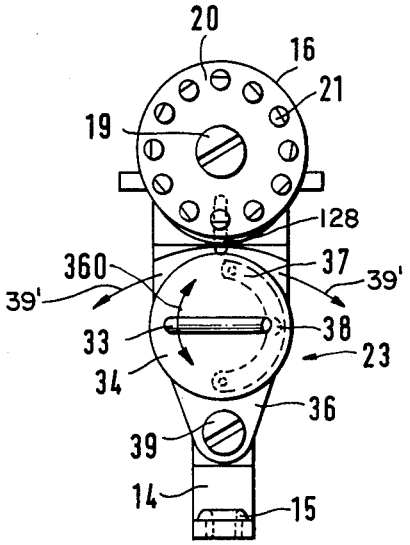
FIG. 3 is a bottom view of the thread guide element, and also illustrating the axial yarn feed wheel.
Figure 6:
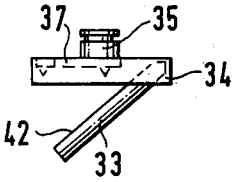
Figure 7:
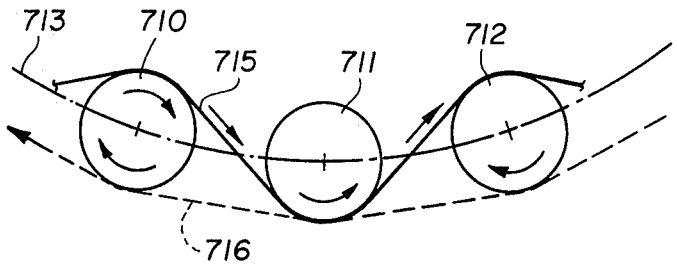

FIGS. 4, 5 and 6 are side views of the yarn guide element of FIG. 3, rotated, respectively, 90° and 180° with respect to the illustration in FIG. 4, and showing the different positions of the yarn guide element; and FIG. 7 is a highly schematic illustration of the paths of drive belts possible with the yarn guide element of the present invention, as contrasted with previously used paths of the supply belts.

The yarn supply apparatus (FIG. 1) has a cylindrical storage drum 1, formed as a pin-cage structure, in which axially extending pins are set between a pair of end disks 2, 2' in which the lower end disk 2 is formed with a circumferential run-off edge of flange 3. The upper disk 2' is connected with a drive shaft 4, coaxial with the axis of rotation of drum 1, which is journalled by bearings 5, 6 in a support 7. Support 7 can be clamped, for example by means of a hook 8, to the frame of the textile machine, for example to a support ring of a circular knitting machine.

The drive shaft 4 is secured to a coupling disk 9 which can be selectively engaged with a pulley 10 or a pulley 11. The pulleys 10, 11 are driven by drive belts, for example of different drive speed, or may have different diameters. They are journalled by ball bearings 12, 14 on the drive shaft 4 and are freely rotatable with respect thereto. Depending on the particular position of the coupling element 9, either one of the pulleys 10 or 11 are connected to the drive shaft 4.

An arm 14 is rigidly secured to the frame 7. The arm 14 carries a thread guide eye 15 at the lower end thereof, extending parallel to the axis of the drum 1. An axial feed stub-tooth gear or pin-wheel 16 is journalled on arm 14, freely rotatable about an axis 17.

Figure 1:
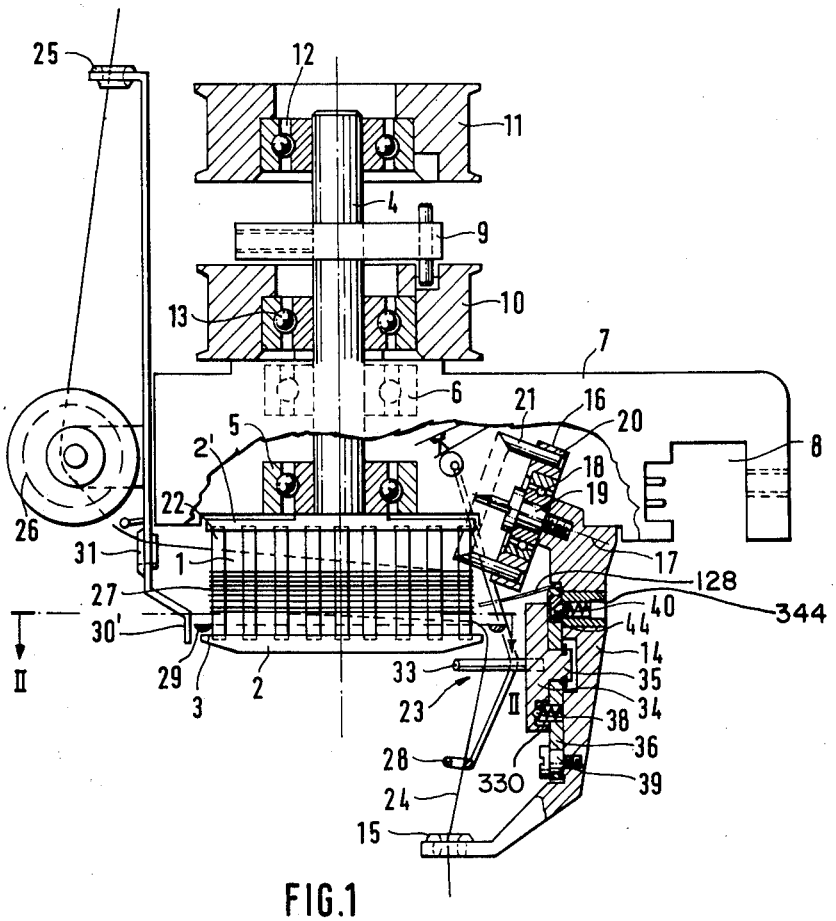
FIG. 1 illustrates a positive thread supply drum, in part axial section, in which all components not essential for an understanding of the invention are shown schematically or have been omitted.

The axial feed wheel or gear 16 is journalled in ball bearing 18 which, in turn, is secured by bolt 19, defining axis 17, to the arm 14. The gear or wheel 16 includes a disk 20 which has projecting teeth or pins 21 which engage in the space between the pins or rods 22 which form the cage of the drum 1, as seen in FIG. 1. The axis of rotation 17 of the axial feed gear or wheel 16 includes an acute angle with the axis of rotation of the drum 1. A detailed description of the axial feed wheel or gear and its operation is found in the cross referenced co-pending application Ser. No. 642,655, filed Dec. 19, 1975, FECKER et al.

A thread guide element 23 is located beneath the drum 1, laterally of the path of the thread being pulled off the drum 1 and secured to the support arm 14. The thread guide element 23 includes a pin 33 extending inwardly over the edge of the flange 3 over which yarn 24 is pulled off from the drum 1, located at a pull-off position. The thread guide element 23, therefore, defines a predetermined pull-off point or location for the drum.

The yarn or thread 24 is supplied over a supply eye 25 to a thread brake 26, and then through a further supply eye 31 to be tangentially wound on the storage drum 1. About 10 to 20 loops or windings on the storage drum 1 form a storage winding 27 thereon; the lowest one of the loops or windings is then pulled off over the flange 3. The yarn or thread 24 then passes by the yarn guide pin or finger 33, of the yarn guide element 23, through the eye 28 of a supervisory thread-break detector, and then to the supply eye 15 for further guidance to a utilization position, for example to the feed of a circular knitting machine.

Figure 2:
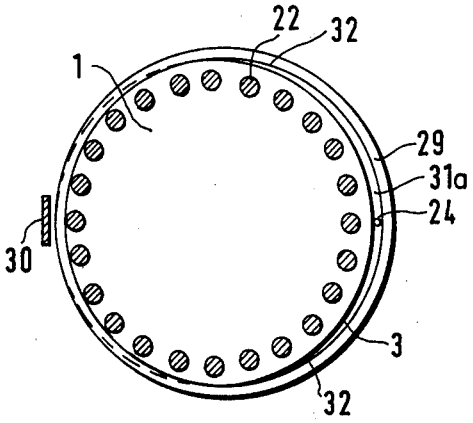
FIG. 2 is a section along line II—II of FIG. 1, illustrating the storage drum.

A floating ring 29 is loosely seated on the drum 1 (FIG. 2). Ring 29 is supported on the end disk 2. It has a slightly larger diameter than the diameter of drum 1. The diameter of drum 1 itself is less than that of the pull-off edge or flange 3. Ring 29 thus cannot be removed from the drum 1. The ring 29 is axially positioned by a stop 30 which is secured in radially fixed position with respect to the axis of rotation of drum 1, for example by being attached and positioned by the support frame 7. The radial spacing of stop 30 is so selected that a small space 31 *a* (FIG. 2) is left between the interior diameter of the ring 29 and the edge of the flange 3 of the lower disk 2, thus permitting free passage of the yarn 24 therethrough. The free space 21 becomes gradually smaller along the circumference of the ring 29, and is generally sickle-shaped. At position 32 the space 31 essentially becomes zero and, therebeyond, the ring 29 will overlap the edge 3 of the lower flange 2.

The thread guide element 23 is best seen in detail in FIGS. 1 and 3 to 6. A cylindrical pin or finger 33 is secured to a rotatable socket disk 34. Socket disk 34 can be rotated by 180°; it is attached to a central hub 35 which, in turn, is secured in a swing lever 36. The hub 35 and hence disk 34 are rotatable about an axis transverse to the axis of rotation of drum 1. The swing lever 36 is secured on the support arm 14. The finger 33 forms an acute angle with respect to the socket disk 34. The angle is not critical; about 45° is suitable. The thread being pulled off the axial end of drum 1 is guided in the space included by the acute angle (see FIGS,. 4, 6). Preferably, the disk 34 can be locked in either one of three positions by rotation thereof, as indicated by arrow 36 (FIG. 3), by engagement of a spring-loaded ball 38 (FIG. 1) in a groove 330 formed on the rear side of disk 34, and formed with locating depressions.

A holding pin 39 holds lever 36 on arm 14 for rotation into and out of the plane of the drawing, FIG. 1, or along either one of arrows 39' (FIG. 3). It is held in its normal position shown in FIG. 3 by a spring-loaded ball 40 engaging a matching depression formed in the arm 36. Preferably, the force of spring loading both of ball 38 as well as of ball 40 is adjustable.

Operation: Let it be assumed that the drum 1 is rotating, being driven by shaft 4 which is in engagement with one of the drive pulleys 10, 11 over the coupling 9. The yarn 24 is guided to the circumference of drum 1 through guide eye 31, for tangential application and winding on the drum 1. The supply or storage winding 26 will form on drum 1. The yarn feed wheel or gear 16 will move the storage windings 27 axially downwardly by engagement of the teeth 21 with the uppermost wrap or loop of the windings, as explained in detail in connection with the aforementioned application. The gear or wheel 16 will rotate about its axis 17, the teeth continuously pushing the winding 27 axially downwardly. Since the axis 17 of the wheel or gear 16 is inclined with respect to the axis of the drum 1, forming an acute angle therewith which includes always the upper wrap of the winding 27, the upper winding is pressed radially from the outside towards the rods 22 of the drum 1 so that piling of superimposed windings is effectively prevented. The drum 1 may be formed in various ways, and need not be constructed of pins or rods between two spaced disks; it can be a solid body with a corrugated or undulated surface in which the undulations are deep enough to permit engagement of the teeth 21 of gear or wheel 16. A solid body with slits formed therein is also suitable.

Yarn 24 is pulled off the lower end of the storage or supply windings with the same supply speed as the speed of supply of the yarn to the drum. The pulled-off yarn 24 is guided over the pull-off edge 3 and, if the yarn tension is properly adjusted, will pass freely through the space 31*a* between ring 29 and the edge 3, as seen in FIG. 2. The thread guide element 23 is so set that the yarn is caught in the acute angle between the socket portion 34 and the finger 33. The finger 33 is formed with a guide edge 42 (FIGS. 4, 6) for lateral guidance of the thread. This edge is preferably rounded and polished. The guide edge 42 so guides the yarn 24 that it is not carried along by the rotary movement of the edge 3 upon rotation of the drum. Thus, a pull-off position, in space, is defined with respect to the axis, or circumference, respectively, of the drum 1 at any instant. Due to the inclination of finger 33, the yarn being pulled off is guided radially outwardly with respect to the circumference of drum 1.

The finger 33 can have various forms; rather than being straight, it could be bent in hook shape, so arranged that it forms a suitable guide surface 42 for the yarn.

After running through the acute angle formed by the disk 34 and finger 33, the yarn is carried through the eye or hook 28 of a stop-motion sensor or thread break sensing element, and then through the supply eye 15 to the utilization point at the textile machine, for example to the thread guide at the feed of a knitting machine.

If the direction of rotation of the drum is to be reversed, then it is merely necessary to rotate disk 34 by 180°, thus moving the acute angle formed between finger 33 and disk 34 to point in the other direction, for example by changing the position from that shown in FIGS. 3 and 4 to the position shown in FIG. 6. The yarn 34 can then be supplied to the drum 1 at the other side of the circumference thereof, so that the windings will be reversely wound with respect to the showing in FIG. 1. The respective positions of the disk 34 are locked by the socket-spring-loaded ball combination 38, 330.

In some installations, it is desired to have intermittent yarn feed, rather than positive yarn feed; in such arrangements, the drum is operating intermittently and when driven rotates at a substantially higher speed than that corresponding to the pull-off speed in order to accumulate storage windings on the drum. For such installations, and for any application in which the yarn is not to be pulled off the drum 1 at a fixed pull-off position, but rather should be free to run off the run-out edge 3 at any point, finger 33 is placed in a disabling position by rotating it 90° with respect to the position of FIG. 3, that is, in the position shown in FIG. 5. In this position, the yarn 34 runs laterally adjacent finger 33 and is not influenced thereby.

It is possible that, due to inattention; the finger 33 is in a position which is inappropriate with respect to the direction of rotation of drum 1. This does not cause damage to the yarn, nor tangling; if the direction of rotation is reversed with respect to the proper position of finger 33, the thread will run from the edge 3 outside of the finger 33, thus being automatically released from the thread guide device 23. This will apply a lateral force, however, on the stop-motion sensing eye 28 and stop the machine, so that the finger 33 can be set into proper position. No damage to the yarn, nor to the fabric, will result.

The thread guide element 23 can easily be moved for adjustment of the unit for right or left-hand operation, that is, for rotation of the drum 1 in either clockwise or counter-clockwise direction with respect to the frames 7, 8. No changes other than flipping of the disk 34 are necessary, and the disk 34 will be locked in position by the spring-loaded ball 38.

If the tension of the thread 24 being pulled off rises, for example due to erroneous adjustment of the textile machine, pin 33 will have a laterally directed force applied thereto which is of such magnitude that the spring force exerted by ball 40, which holds the entire lever 36 in position, is exceeded. The lever 36 will then flip laterally about pin 39; this releases the yarn 24 from finger 33 and causes operation of the stop-motion device controlled by eye 28. Again, the thread will not tear and no damage to the textile fabric or to the machine, or to the continued operation upon clearance of the malfunction will result.

Lever 36, and movement thereof, can be utilized to simultaneously effect supervisory control function, and particularly to be included in the stop-motion circuit of the machine. The additional, usually used stop-motion thread guide eye 28 can then be omitted. in such an embodiment, the ball 40 is set in an insulating bushing which has an electrically conductive strip along the inside thereof, terminating in a contact 344. Ball 40 is hence in electrical contact with terminal 344. The ball 40 engages in a depression formed in an insulating counterelement 44 set into the lever 36. When lever 36 moves out of its rest position, the ball 40, in electrical contact with terminal 344, is moved away from the insulating bushing 44 to complete an electrical circuit from terminal 344 to the frame or chassis of the machine and thus complete an electrical contact operating the stop-motion system of the machine.

Fluff, dirt or other contamination may cause improper run-out of the yarn; due to stoppage at the guide eye 15, or somewhere else in the machine, or due to erroneous adjustment of the textile machine, less yarn may be used than supplied by the drum 1. The edge 3 will then take the yarn laterally along and release it from the finger 33, and will tend to place a winding of the yarn on the storage drum 1. The yarn will then catch in the gap of decreasing size, which gradually becomes narrower and narrower in sickle-shaped fashion to point 32 (FIG. 2) between the inside of the ring 29 and the edge 3. The yarn which is so clamped will necessarily carry along the eye of the feeler 28 of the stop-motion device to cause stopping of the machine and hence, agan, shut-down before damage to the yarn, or to the fabric being made can result. The machine is thus positively protected against malfunction, regardless of source. The same operation will result if the eye 28 is not used and, rather, the electrical stop-motion of circuit 344-44 is utilized.

The stop-motion sensing eye 28 is located immediately adjacent the finger 33 of the yarn guide device 23 and without any intervening thread guide eye, as best seen in FIG. 1. The stop-motion sensor 28 can be laterally loaded by a spring 128 (FIGS. 1, 3) preferably surrounding the holder for the thread guide eye so that the eye 28 can, simultaneously, function as a balancing and damping arm, to dampen high-frequency changes in thread tension which arise in normal operation of a knitting machine. When applied to a knitting machine, therefore, the sensing arm to which eye 28 is connected can readily be so constructed that further improvement in quality of the resulting fabric can be obtained.

High-feed circular knitting machines use a large number of yarn supply apparatus assemblies. They are therefore located only a small distance apart along the circumference of the kintting machine. As a result, and when driven by a common belt engaging the pulleys 10, 11, the angle of engagement of the respective belts and of the pulleys is small. Referring to FIG. 7: A number of pulleys 710, 711, 712 of adjacently located thread guide supply apparatus are shown, secured about the circumference 713 of a holding ring of a knitting machine, shown schematically only, the chain-dotted line 713 indicating the center positions of the respective pulleys 710, 711, 712. As clearly seen by FIG. 7, a belt 716 engaging the outer circumference of the pulleys 710, 711, 712 will have only a small wrap or engagement angle with respect to any one of the pulleys. This small angle permits transfer of only a comparatively small torque to the respective pulley. In accordance with the present invention, the belt can be looped differently, as shown by the solid line 715. Of course, the direction of rotation of respectively alternate thread supply pulleys will be reversed, as shown by the respective direction arrows. Locating the drive belt as shown by solid line 715 results in a substantially greater engagement angle of the belt with respect to the pulleys. The simple change-over permitted by the structure of the present invention permits locating thread supply apparatus which alternately operate in clockwise and counter-clockwise direction. The undulating drive belt, with its much greater engagement angle permits transfer of substantially larger torque values; the particular location of the drive belt can be chosen, as selected, and change in the direction of rotation, replacement of specific thread guide units, or other alterations affecting the direction of operation of the thread guide supply elements can readily be accomodated by merely rotating the disk 34.

The thread guide element 23 and its finger 33 can readily be set for the specific direction of rotation of the drum, for proper adjustment thereof to accomodate either clockwise or counter-clockwise operation, or random feed, at a disabled position, the finger being held in position by the spring-loaded ball-socket arrangement 38, 330. Erroneous adjustment either of the thread guide finger or any malfunction of the machine does not cause yarn tension to rise so quickly that the yarn will tear before the stop-motion device responds; in structures of the prior art, no thread reserve, usually, is present between the thread supply apparatus and the particular utilization point, typically the knitting feed of a circular knitting machine. Upon tearing of the thread, the fabric will have a hole therein since the machine will not stop instantaneously; the machine itself or components thereof may suffer damage. This defect is avoided by the structure including the lever 36 which can rotate about its pin or axis 39. If the thread tension increases, for example due to lateral clamping of the thread between the edge 3 and the ring 29, the thread is released from its guide element thus increasing the length of the thread available between the drum and the utilization point, preventing tearing of the thread while simultaneously operating the stop-motion device (either the sensor 28 or the release formed by circuit 344-lever 36, or both). The thread, thus, is automatically released upon excessive increase of thread tension so that tearing of the thread or yarn and its consequent undesirable results are avoided. The converse may also happen, however, namely that the thread, rather than being placed under undue tension, is not pulled off at all, for example due to stoppage in the guide eye 15 or other malfunction in the machine. This case, also, reliably results in protection of the machine as well as of the fabric being made. The ring 29, in combination with the stop 30 which constrains the radial play of the ring 29 circumferentially of the edge 3 causes pinching of the thread. Due to the weight of the ring and the friction between the ring and the thread, the thread will slowly be carried along the circumference to form another winding at the lower edge of the stack of windings 27, but also laterally carrying the thread and thus causing stop-motion operation of the stop-motion device, either of eye 28 or flipping of lever 36, or both. In normal operation, however, the space between the ring 29 and edge 3, through which the yarn can pass, permits free passage with minimum interposed friction.

Various changes and modifications may be made within the scope of the inventive concept.

We claim:

1. Positive yarn supply apparatus comprising a support frame (7, 14);

a rotatable storage drum capable of rotation in a clockwise or counter-clockwise direction (1) journalled in the support (7, 14) for winding thereon yarn (24) to form a stack of yarn storage supply windings (27), the yarn being supplied tangentially to the surface of the drum (1) and being removed axially over the end thereof;

and means (23; 29, 30, 31, 32) controlling the pull-off position of the yarn (24) including an essentially elongated and symmetrical yarn guide element adjustably secured to the support frame for its selective extension into the path of the yarn so that it is contacted at either side by the yarn when placed in selectively different yarn guiding positions and thereby positively guides the yarn regardless of the direction of rotation of the storage drum (1).

2. Apparatus according to claim 1, wherein the yarn guide element (23) includes a guide finger (33) extending in a direction forming an angle with respect to the path of the yarn being drawn or pulled off the axial end of the drum (1), the yarn, when being guided by the guide finger (33) exerting a force against the finger when the finger is in a position with its angle of inclination in proper direction with respect to the direction of rotation of the drum, said yarn being released from the finger and located opposite the side thereof when not in proper operation, when the direction of rotation of the drum is reversed, whereby reversal and inadvertent failure to re-position the finger will not cause tangling or catching of the yarn, and consequent damage thereto.

3. Apparatus according to claim 2, wherein the guide finger (33) extends in a direction essentially transverse to the direction of pull-off of the yarn and is located beneath the pull-off position of the yarn from the drum, projecting at an inclination into the pull-off path of the yarn and is formed with a guide surface thereon located to pull the yarn away from the drum, the finger (33), when properly positioned, guiding the yarn over said guide surface with its angle of inclination in proper direction with respect to the direction of rotation of the drum to guide the yarn over said guide surface (42) radially outwardly of the drum and, when the direction of rotation of the drum (1) is reversed, permitting the yarn to slip off the inclined guide surface and free the yarn from the guide finger;

selective re-adjustment of the guide finger with respect to the support, and hence with respect to the drum, changing the angle of inclination and re-establishing guidance of the yarn over said guide surface.

4. Apparatus according to claim 3, further comprising stop-motion means (28; 44, 344) located with respect to the path of the yarn to be ineffective when the yarn is properly guided by the yarn guide finger (33) over the guide surface (42), the stop-motion means being operated when the yarn is tensioned or slackened in its path and thereby exerts either:

a. an excessive force against the guide finger and deviates from its path, or b. becomes released from the guide finger and thereby deviates from its path.

5. Apparatus according to claim 3, further comprising means (34) movably securing the guide finger to the support and located adajcent the circumference of the drum, holding said guide finger in position to extend beneath the drum essentially transverse to the circumference thereof, the guide finger forming an acute angle with respect to a plane tangential with respect to the drum at the pull-off point of the yarn from the drum.

6. Apparatus according to claim 5, wherein the securing means (34) comprises movable means located in a plane outwardly of and essentially parallel to said tangential plane and securing the guide finger at an acute angle with respect thereto, the apex of said acute angle being located laterally of the pull-off point of the yarn from the drum to guide the yarn, when properly positioned with respect to the direction of rotation, in the inclined angle between said drum surface and said guide finger, the yarn being permitted so slip off the inclined surface and released therefrom within the acute angle when the direction of the drum is reversed without reversal of the position of the apex of the acute angle formed by the guide finger with the movable means and with respect to the pull-off point of the yarn from the drum.

7. Apparatus according to claim 6, wherein the guide surface (42) is located at the side of the guide finger facing the movable securing means (34).

8. Apparatus according to claim 6, wherein the movable securing means comprises a disk (34) rotatably journalled in the support frame (14) to rotate about an axis transverse to the axis of rotation of the storage drum (1).

9. Apparatus according to claim 8, further including resilient stop means (38, 330) locking said disk (34) in positions 180° offset with respect to each other and placing the apices of the acute angle to the right or to the left of the axis of rotation of the disk to locate the finger (33) to pull the yarn away from the drum in dependence on the direction of rotation of the drum.

10. Apparatus according to claim 9, wherein said resilient locking means includes a third intermediate position at 90° with respect to either of said positions, the finger (33), when the disk (34) is placed in said intermediate position, being located in a common plane with the axis of rotation of the drum and hence being moved out of the pull-off path of the yarn from the drum.

11. Apparatus according to claim 4, wherein the stop-motion means includes insulated contact means (40, 44, 344), a holding disk (34) securing the yarn guide finger movably to the support frame (7, 14), said contact means responding to excessive force being applied by the yarn on the finger and to move the support disk, and hence change the electrical circuit condition of said contact means, whereby the means controlling the pull-off of the yarn simultaneously functions as electrical yarn supervisory or stop-motion element.

12. Apparatus according to claim 1, further comprising holder means (36, 39) movably securing the pull-off control means (23; 29, 30, 31, 32, 33) on the support (7, 14), and means (40, 44) releasably locking said holder means (36, 39) in position on said support frame (7, 14);

said holding means being released from said locking means upon excessive force being applied by the yarn against the yarn guide element, movement of the holding means being in a direction to release the yarn from the guide element and thus prevent tearing of the yarn upon excessive tension.

13. Apparatus according to claim 12, wherein the holding means comprises a swing lever (36) and a pivot (39) mounting the swing lever for tipping movement to move the yarn guide means out of the path of the yarn.

14. Apparatus according to claim 13, further comprising stop-motion means (40, 44, 344) including electrical switch contact means, movement of said lever (36) upon unlocking of said locking means effecting change-of-state of the switch contact and thus permit initiation of a stop-motion operation to stop the machine.

15. Apparatus according to claim 1, wherein the drum comprises a run-off flange located at the axial end about which the yarn is being pulled or drawn off;

a loose ring (29) of lesser diameter than the outer diameter of the flange (3) being loosely located on said flange;

a fixed stop (30) radially positioning the loose ring (29) with respect to the center of rotation of the drum and located to provide a gap between the flange (3) and the ring (29) at the pull-off position adjacent the yarn guide element (23, 33), the gap decreasing uniformly to have a double sickle-shaped decreasing width from a maximum gap width adjacent said pull-off position.

16. Apparatus according to claim 15, further comprising a stop-motion sensing finger (28) in the path of the yarn located immediately adjacent the yarn guide element (23, 33), without intermediate yarn guide means.

17. Apparatus according to claim 16, further comprising resilient bias means (128) laterally located adjacent the stop-motion sensing eye (28) and elastically compensating high-frequency variations in yarn tension.

18. Apparatus according to claim 1, further comprising at least two rotation transmitting means (10, 11) coupled to the drum (1) to drive the drum, selectively, at different rotational speeds.

19. The combination of a plurality of similar positive yarn supply apparatus as claimed in claim 1 located adjacent each other, each of said yarn winding apparatus having a drive pulley 10, 11) secured thereto to provide rotational drive force to the respective storage drum (1), and drive belt means (715) engaging said drive pulleys and looped alternately at one side and then on the other about said drive pulleys to impart respectively opposite directions of rotation to adjacently located drums (1), the drive belt means (715) being located in an undulating path to provide maximum engagement angle thereof with the respective pulleys, the yarn guide elements (23, 33) of adjacently located supply apparatus being alternately located on the respective support and extending into the paths of the yarns being supplied by the respective drums, along alternate sides with respect to adjacent yarn supply apparatus.

20. The combination of claim 19, in further combination with a circular knitting machine having a yarn supply belt drive, said belt means (715) being part of said belt drive.

21. Apparatus according to claim 1, wherein the yard guide element comprises a guide finger (33) extending into the path of the yarn (24) in a direction forming an angle with respect to the path of the yarn being drawn, or pulled off the axial end of the drum (1), located beneath the pull-off position of the yarn from the drum, a holding means (14) located along side the drum, said finger being secured to said holding means with one end thereof and positioned to form an acute angle with a plane tangential to said drum, the apex of said acute angle being located laterally of the pull-off point of the yarn from the drum, the apex of said angle being selectively positionable at either side of said pull-off point to place the finger selectively at either side of the yarn and thereby guide the yarn regardless of the direction of rotation of the yarn storage drum (1).

* * * * *